United States Patent [19]

Pogson et al.

[11] 4,040,478

[45] Aug. 9, 1977

[54] EXTERNAL TUBE ARTERY FLEXIBLE HEAT PIPE

[75] Inventors: John T. Pogson, Seattle; Donald A. Streck, Des Moines, both of Wash.

[73] Assignee: The Boeing Company, Seattle, Wash.

[21] Appl. No.: 586,120

[22] Filed: June 11, 1975

Related U.S. Application Data

[62] Division of Ser. No. 402,655, Oct. 1, 1973, Pat. No. 3,913,665.

[51] Int. Cl.[2] ..... F28D 15/00

[52] U.S. Cl. ..... 165/105; 165/96

[58] Field of Search ..... 165/105, 96

[56] References Cited

U.S. PATENT DOCUMENTS

| | | | |
|---|---|---|---|
| 3,543,839 | 12/1970 | Shlosinger | 165/105 X |
| 3,604,503 | 9/1971 | Feldman, Jr. et al. | 165/105 X |
| 3,609,991 | 10/1971 | Chu et al. | 165/105 X |
| 3,614,981 | 10/1971 | Coleman et al. | 165/105 X |
| 3,677,336 | 7/1972 | Moore, Jr. | 165/105 |

*Primary Examiner*—Albert W. Davis, Jr.
*Attorney, Agent, or Firm*—J. Peter Mohn; K. W. Thomas

[57] ABSTRACT

A flexible heat pipe employing external tube arteries in the adiabatic region to transfer the heat pipe working fluid from the wick contained in the condenser portion to the wick contained in the evaporator section.

6 Claims, 8 Drawing Figures

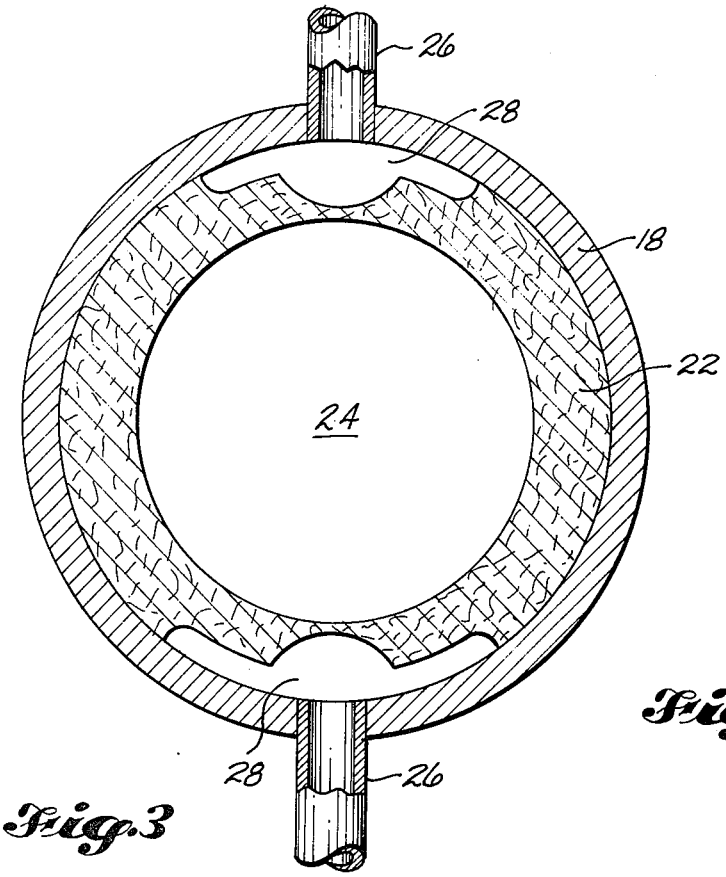
Fig. 3
Fig. 5
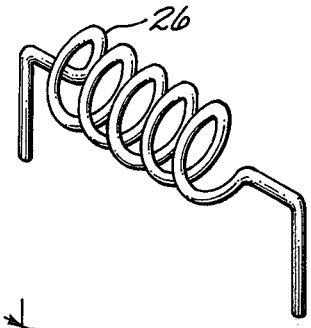
Fig. 4
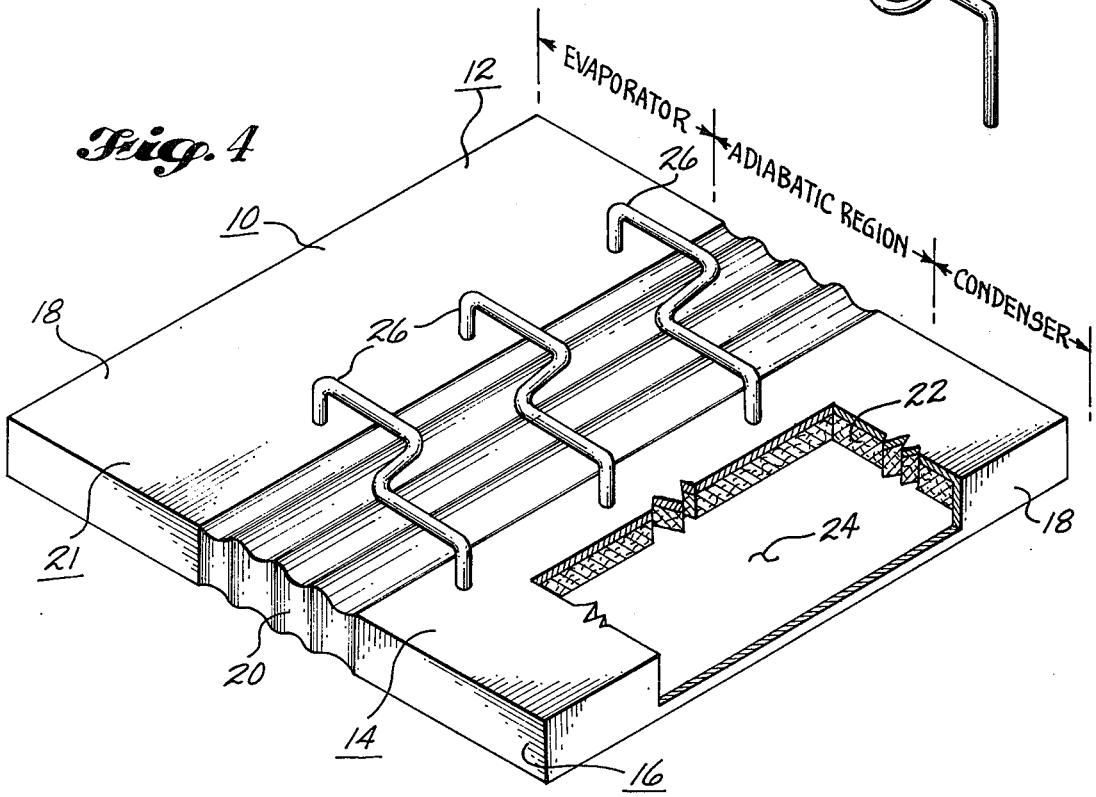

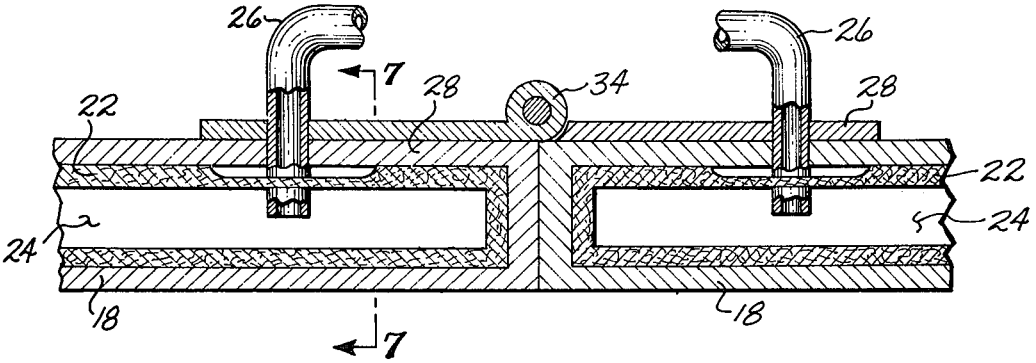
Fig. 6
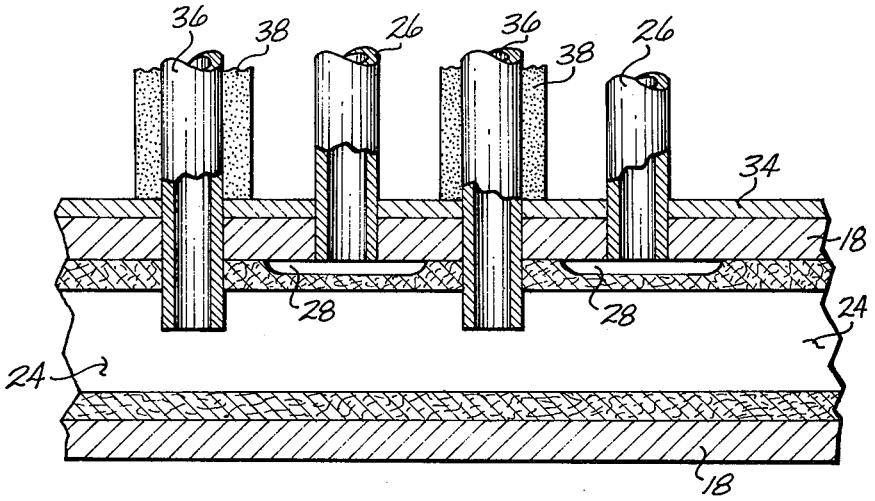
Fig. 7
Fig. 8
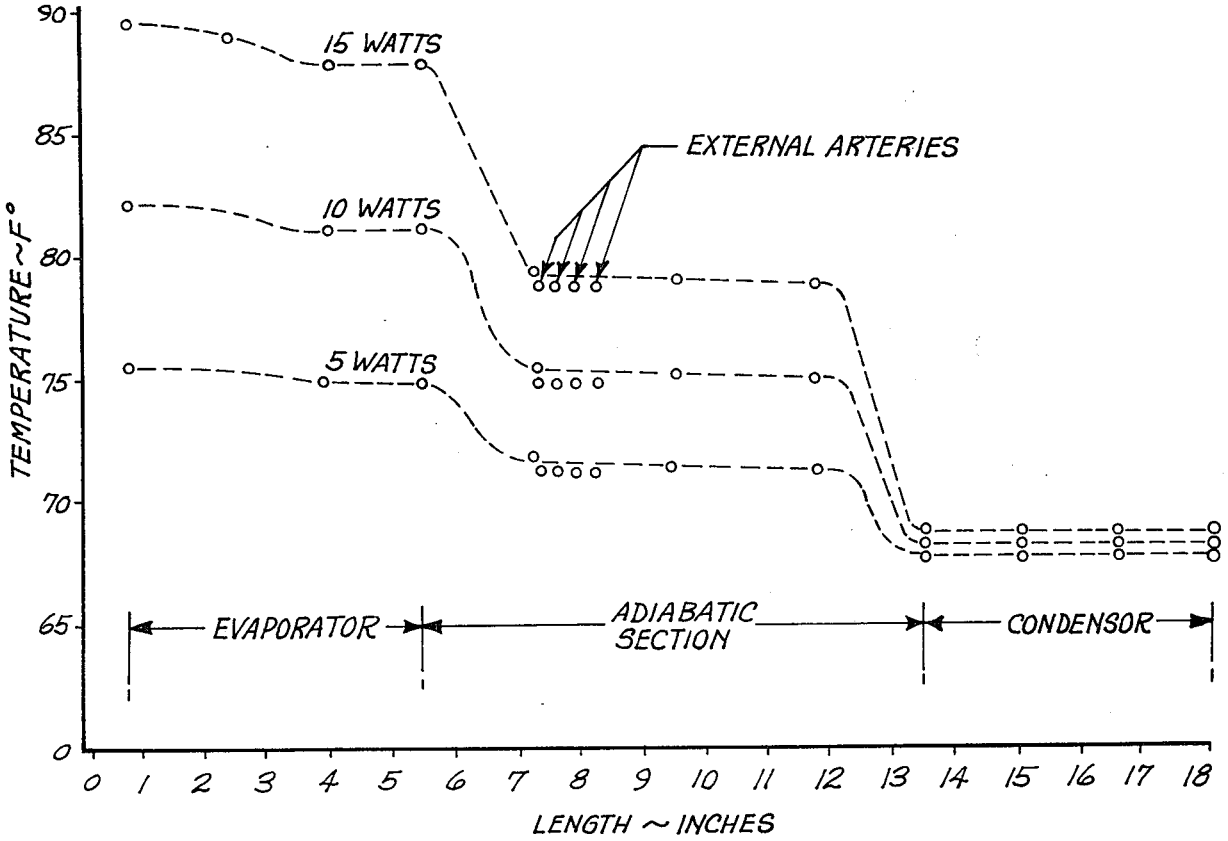
TEMPERATURE PROFILE OF METHANOL FLEXIBLE HEAT PIPE

EXTERNAL TUBE ARTERY FLEXIBLE HEAT PIPE

This is a division of application Ser. No. 402,655, filed Oct. 1, 1973, now U.S. Pat. No. 3,913,665.

BACKGROUND OF THE INVENTION

1. Field of the Invention

The present invention relates to heat conductive devices and more particularly to heat pipes wherein a wick is employed to transfer a fluid in an evaporative/-condensation cycle through capillary action.

2. Description of the Prior Art

A heat pipe is a closed environment containing a fluid which constantly undergoes an evaporative/condensation cycle. A continuous wick transfers the condensed fluid from the cold portion or condenser to the hot portion or evaporator where the fluid returns to the vapor state. The vapor then moves through the closed environment in that portion not occupied by the wick back to the condenser where it returns to the fluid state. If the heat pipe is to remain operative, the integrity of the cycle must be maintained. Loss of fluid continuity in the wick is the critical item in the cycle. Typically the wick is constructed of a material or by a process which will yield a porous structure comprising a series of intermeshed capillaries. As the fluid in the evaporator enters the gaseous state a high meniscus is formed in these capillaries. The fluid is drawn toward the evaporator by the surface tension of the meniscus. If a dry spot should form across the wick the continuity of this fluid flow may be lost and the cycle broken. Likewise if the "prime" of the wick is lost, the cycle may not begin when heat is applied to the evaporator section of a heat pipe in the static condition.

The foregoing is particularly important when it is desired to incorporate a flexible portion within the heat pipe as may be required in many applications particularly where vibration or body forces i.e. gravity may be a factor. The environmental enclosure of the heat pipe can be made flexible through the use of common materials such as flexible tubing. Providing a flexible wick with adequate performance characteristics which will resist forming discontinuities or changes in performance characteristics is another matter.

The use of helical capillary passages contained within a bellows has been advocated but is limited by surface tension pumping capabilities. Consequently, the total energy that can be dissipated by the heat pipe in a gravity environment is small. Likewise, a wire mesh cut on the bias has been used to bridge the discontinuity in the wick across the flexible portion. In this case the fluid flow capacity of the wire mesh is adequate but the screen wick tends to pull away from the tube wall causing an inefficiency and loss of lifting capacity where the condensor is located above the evaporator.

Another feature which would be desirable in a heat pipe is the ability to provide a simple on/off or "diode" capability. An external artery conducting the working fluid can provide such control. If the capillary is heated, causing the liquid to vaporize within the capillary, the cycle will stop. When the capillary is cooled, vaporization within the artery cannot take place and the cycle will continue.

Therefore, it is an object of the present invention to provide a high performance flexible heat pipe of low flow resistance, high resistivity to loss of prime, and high flow capacity.

It is another object of the present invention to provide a high performance flexible heat pipe which can be constructed of non-special materials.

It is yet another object of the present invention to provide a high performance flexible heat pipe which allows for the cooling or heating of any external arteries contained in the structure.

It is a further object of the present invention to provide a flexible heat pipe that is self priming.

It is a final object of the present invention to provide a flexible heat pipe that eliminates the need for continuous wicks and permits the use of composite wick concepts.

Other objects and advantages of the present invention will become apparent from the figures and specifications which follow.

DESCRIPTION OF THE DRAWINGS

FIG. 3 is a cross sectional view of FIG. 1 at 3—3.

FIG. 4 is a heat pipe of a slab configuration employing a flexible joint as disclosed by the present invention between a solid evaporator and solid condenser. In this example the capillary arteries connecting the wicks are of a tortion bar configuration as where minimal flexure is anticipated.

FIG. 5 is an optical configuration for an interconnecting capillary artery for use with slab heat pipes as in FIG. 4 allowing greater flexure with less resistance.

FIG. 6 is a partial cross section through a slab heat pipe as shown in FIG. 4 wherein the two slabs are sealed and the flexure interconnection is replaced with a hinge means. In this configuration, both the wicks and vapor paths are interconnected with capillary arteries.

FIG. 7 is a partial cross section at 7—7 in FIG. 6 showing the staggering of the capillary arteries to interface with the wick and vapor space.

FIG. 8 is a temperature profile for a methanol flexible heat pipe 0.5 inches in diameter and 1.5 feet in length.

Note that in FIGS. 1 through 7 like functioning elements are numerically the same even though sometimes differently shaped so as to easily interrelate the various species of heat pipe employing the present invention.

DESCRIPTION AND OPERATION OF THE INVENTION

Figure 1:
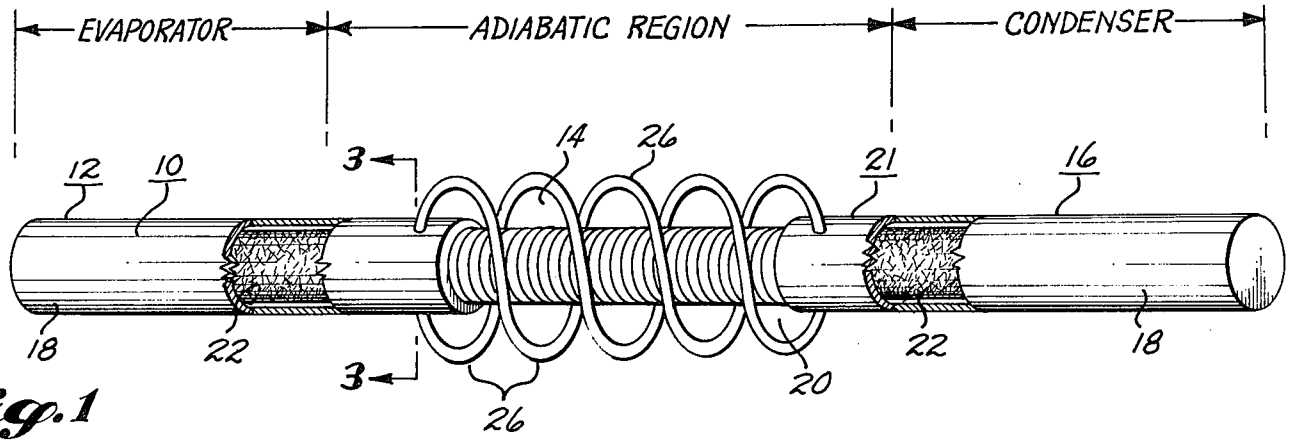
FIG. 1 is a heat pipe employing a flexible section as disclosed by the present invention wherein a felt metal wick is employed.
Figure 2:
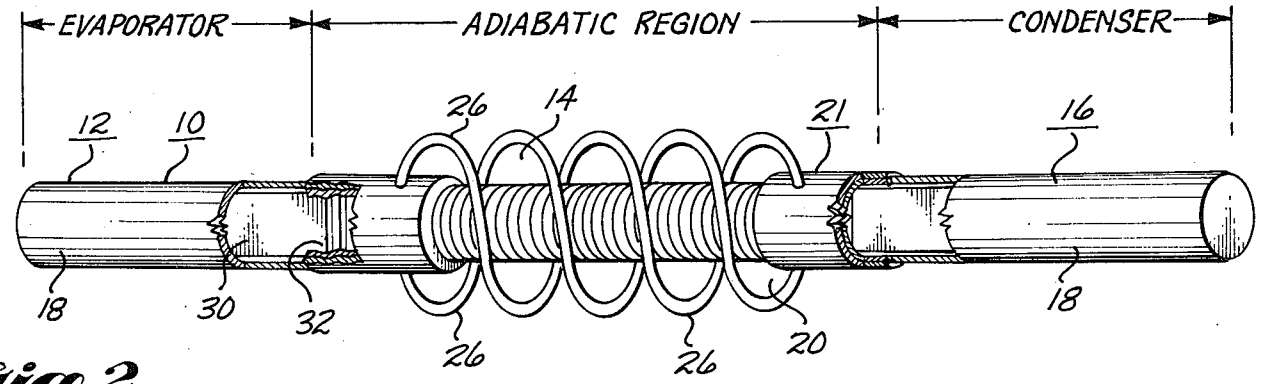
FIG. 2 is a heat pipe employing a flexible section as disclosed by the present invention wherein a slab artery with spirally grooved walls is employed.

The basic heat pipe assembly 10 comprises an evaporator section 12, an adiabatic region 14, and a condenser section 16 as shown in FIG. 1, FIG. 2, and FIG. 4. A liquid (not shown) circulates throughout the assembly 10 carrying heat from the evaporator section 12 to the condenser section 16 as vapor and returning to the evaporator section 12 as a liquid. While the shape of the heat pipe may vary for differing applications as will be described hereinafter, the basic configuration and operation of the present invention will be described in relation to a cylindrical heat pipe as shown in FIG. 1.

Referring to FIG. 1, the rigid portions of the heat pipe are formed by outer enclosures 18. The outer enclosures 18 are completely closed except where they interface with a flexible conduit 20 which interconnects the outer enclosures 18 to form a closed environment assembly 21. Within the outer enclosures 18 and adjacent to the periphery thereof is a porous wick 22 as more clearly shown in FIG. 3. In the preferred embodiment as tested to date the wick 22 is constructed of metal felt. The wick 22 is contained only in the outer enclosures 18 and terminates at the interfaces with the flexible conduit 20. The space remaining within the closed environment assembly 22 provides a vapor path 24 for liquid vapor (not shown) to flow from the evaporator section 12 to the condenser section 16 while the wick 22 provides a path for the return of the liquid (not shown) from the condenser section 16 to the evaporator section 12.

The present invention provides a means for bridging the discontinuity in the liquid flow path as hereinbefore described due to the absence of the wick 22 in the flexible conduit 20. Capillary artery tubes 26 are operably connected through the outer enclosures 18 to provide a path for liquid flow from the wick 22 in the evaporator section 12 to the wick 22 in the condenser section 16. In the preferred embodiment, as depicted in detail in FIG. 3, an artery structure 28 is contained between the wick 22 and the outer enclosure 18 to provide a path for the dispersal of the liquid and reduce pressure loss. The artery structure 28 extends both longitudinally and circumferally for optimal liquid transfer. In a cylindrical heat pipe as shown in FIG. 1 the capillary artery tubes 26 are positioned helically about the flexible conduit 20 to provide flexibility with minimal single point flexure in the capillary artery tubes 26. The material of the capillary artery tubes 26 is determined as is the material of the entire outer enclosure 18 by the physical requirements of containing the liquid used in the heat pipe. The size is determined by the application and is a function of the number of capillary artery tubes 26 and the pressure differential across the flexible conduit 20. Various configurations employing the present invention are described hereinafter.

Referring to FIG. 2, a heat pipe assembly 10 is shown in a cylindrical form as that of FIG. 1. FIG. 2 demonstrates the interfacing technique to be employed where a composite wick structure is used such that there is a poor transfer potential between the wick and the capillaries at their juncture. As shown in FIG. 2 a slab artery with spirally grooved walls 30 replaces the conventional wick. In this case an interfacing wick 32 of metal felt is provided to connect the slab artery 30 to the capillary artery 26. The interfacing wick 32 provides a buffer to contain the liquid and allow transfer between the slab artery 30 and the capillary artery 26 in the optimal manner for each. The interfacing wick 32 incorporates an artery structure 28 as described in conjunction with FIG. 1 herein before.

Referring to FIG. 4, a heat pipe assembly 10 is shown in a slab form with the flexible conduit 20 in the form of a bellows as in an accordion. In the configuration as shown, the capillary arteries 26 are shaped to provide a tortion bar effect providing stiffness and limited flexibility. By incorporating capillary arteries 26 as shown in FIG. 5, the same slab heat pipe would be more flexible and less stiff.

Referring finally to FIG. 6 and FIG. 7, there is depicted a portion of a slab heat pipe in which there are two distinct outer enclosures 18. The flexible conduit 20 of FIGS. 1, 2, and 4 is replaced with hinge means 34. In such an arrangement, if the capillary arteries 26 are of a stiff tortion configuration as shown in FIG. 4, one slab can be folded and latched in place for subsequent automatic deployment when unlatched. Since the continuity of the vapor path 24 is lost, vapor arteries 36 would have to be provided to interconnect the vapor paths 24 as shown in FIG. 6 and FIG. 7. To prevent condensation within the vapor arteries 36 they would have to be surrounded with insulation 38 and of sufficient number and size to provide full vapor flow. The same configuration would, of course, work if the hinge means 34 were removed and the two slabs were physically separated.

What is claimed is:

1. A heat pipe containing a quantity of fluid and being an airtight enclosure composite structure comprising in combination:

a. first enclosure means defining a first space and a second space, said first space containing first internal conductor means for containing and transporting the fluid therethrough as a liquid, said second space being a passageway for containing and transporting the fluid therethrough as a vapor;

b. second enclosure means operatively connected to said first enclosure means and having a flexible passageway disposed adjacent to said second space of said first enclosure means so as to allow the fluid to move from said second space of said first enclosure means into said second enclosure means as a vapor;

c. third enclosure means comprising a third space and a fourth space operatively connected to said second enclosure means, said third space containing second internal conductor means for containing and transporting the fluid therethrough as a liquid, said fourth space being a passageway disposed adjacent to said second enclosure means so as to allow the fluid to move from said second enclosure means into said fourth space of said third enclosure means as a vapor; and, d. flexible external capillary conduit means operatively connected to said first enclosure means and to said third enclosure means, said flexible external capillary conduit means having its ends disposed adjacent to said first internal conductor means and said second internal conductor means so as to allow the fluid to move from said second internal conductor means to said first internal conductor means through said flexible external capillary conduit means, said flexible external capillary conduit means being a spring bias with respect to flexing said first enclosure means relative to said third enclosure means in one plane.

2. A heat pipe as claimed in claim 1 wherein said spring bias is accomplished by shaping a portion of said flexible external capillary conduit means as a helix, said helix being disposed adjacent to said flexible passageway of said second enclosure means.

3. A heat pipe as claimed in claim 1 wherein said spring bias is accomplished by said flexible external capillary conduit means being a tortion bar with respect to said flexing in one plane.

4. A heat pipe as claimed in claim 1 wherein additionally:

a. said first enclosure means and said third enclosure means are operatively interconnected with hinge means; and b. said second enclosure means is an external conduit.

5. A heat pipe containing a quantity of liquid and being an airtight enclosure composite structure comprising in combination:

a. first enclosure means defining a first space and a second space, said first space containing first internal conductor means for containing and transporting the liquid therethrough as liquid, said second space being a passageway for containing and transporting the liquid therethrough as a vapor, b. second enclosure means comprising a plurality of second external conduit means operatively connected to said first enclosure means and being disposed with one end of each of said plurality of second external conduit means adjacent to said second place of said first enclosure means so as to allow the liquid to move from said second space of said first enclosure means into said plurality of second external conduit means comprising said second enclosure means as a vapor, c. third enclosure means comprising a third space and a fourth space operatively connected to said second enclosure means, said third space containing second internal conductor means for containing and transporting the liquid therethrough as a liquid, said fourth space being a passageway disposed adjacent to said second enclosure means so as to allow the liquid to move from said second enclosure means into said fourth space at said third enclosure as a vapor, d. hinge means operatively interconnecting said first enclosure means and said third enclosure means, and e. first external conduit means operatively connected said first enclosure means and to said third enclosure means, said first external conduit means having its ends disposed adjacent to said first internal conductor means and said second internal conductor means so as to allow the liquid to move from said second internal conductor means to said first internal conductor means through said first external conduit means, said first or second external conduit means being a torsion tube width respect to flexing said first enclosure means and said third enclosure means about said hinge means.

6. A heat pipe containing a quantity of liquid and being an airtight enclosure composite structure comprising in combination:

a. first enclosure means defining a first space and a second space, said first space containing first internal conductor means for containing and transporting the liquid therethrough as a liquid, said second space being a passageway for containing and transporting the liquid therethrough as a vapor, b. second enclosure means comprising a plurality of second external conduit means operatively connected to said first enclosure means and being disposed with one end of each of said plurality of second external conduit means adjacent to said second space of said first enclosure means so as to allow the liquid to move from said second space of said first enclosure means into said plurality of second external conduit means comprising said second enclosure means as a vapor, c. third enclosure means comprising a third space and a fourth space operatively connected to said second enclosure means for containing and transporting the liquid therethrough as a liquid, said fourth space being a passageway disposed adjacent to said second enclosure means so as to allow the liquid to move from said second enclosure means into said fourth space at said third enclosure as a vapor, d. hinge means operatively interconnecting said first enclosure means and said third enclosure means, and e. first external conduit means operatively connected to said first enclosure means and to said third enclosure means, said first external conduit means having its ends disposed adjacent to said first internal conductor means and said second internal conductor means so as to allow the liquid to move from said second internal conductor means to said first internal conductor means through said first external conduit means, said first external conduit means and said second external conduit means are disposed substantially helically adjacent to said hinge means.

* * * * *